US012071771B2

(12) United States Patent
Zheng

(10) Patent No.: US 12,071,771 B2
(45) Date of Patent: Aug. 27, 2024

(54) SPLIT FLOORS AND METHOD OF MAKING THE SAME

(71) Applicant: Sumei Zheng, Guangdong Province (CN)

(72) Inventor: Sumei Zheng, Guangdong Province (CN)

( * ) Notice: Subject to any disclaimer, the term of this patent is extended or adjusted under 35 U.S.C. 154(b) by 197 days.

(21) Appl. No.: 17/841,822

(22) Filed: Jun. 16, 2022

(65) Prior Publication Data

US 2022/0403666 A1 Dec. 22, 2022

(51) Int. Cl.

| | |
|---|---|
| ***E04F 15/02*** | (2006.01) |
| ***E04F 15/08*** | (2006.01) |
| ***E04F 15/10*** | (2006.01) |

(52) U.S. Cl.

CPC ..... *E04F 15/0215* (2013.01); *E04F 15/02* (2013.01); *E04F 15/02038* (2013.01); *E04F 15/087* (2013.01); *E04F 15/102* (2013.01); *E04F 15/105* (2013.01); *E04F 15/107* (2013.01); *E04F 2201/04* (2013.01)

(58) Field of Classification Search

CPC ..... E04F 15/0215; E04F 15/02038; E04F 2201/04; E04F 15/087; E04F 15/102; E04F 15/105; E04F 15/107; E04F 15/02

USPC ..... 52/589.1–592.6; 428/40.1, 42.2, 42.3

See application file for complete search history.

(56) References Cited

U.S. PATENT DOCUMENTS

| | | | | | |
|---|---|---|---|---|---|
| 2,882,714 | A * | 4/1959 | Gagle | E04F 15/10 | 405/270 |
| 3,494,059 | A * | 2/1970 | Minasian | G09F 3/10 | 428/40.1 |
| 4,604,153 | A * | 8/1986 | Melbye | B05C 17/06 | 428/423.7 |
| 5,662,977 | A * | 9/1997 | Spain | B29C 59/046 | 428/141 |
| 5,671,575 | A * | 9/1997 | Wu | E04F 19/0481 | 52/480 |
| 6,129,964 | A * | 10/2000 | Seth | C09J 7/29 | 428/41.5 |
| 7,155,871 | B1 * | 1/2007 | Stone | E04F 15/10 | 52/611 |
| 8,429,873 | B2 * | 4/2013 | Devine, Jr. | E04B 1/14 | 52/592.1 |
| 8,607,532 | B2 * | 12/2013 | Permesang | E04F 13/08 | 52/592.1 |
| 9,765,530 | B2 * | 9/2017 | Bergelin | E04B 1/68 | |
| 2005/0281997 | A1 * | 12/2005 | Grah | B32B 37/10 | 428/537.1 |

(Continued)

*Primary Examiner* — Brent W Herring

(57) ABSTRACT

A split floor contains multiple bottom plates and multiple top plates. The multiple bottom plates are fixed on a ground, and multiple top plates connected on the multiple bottom plates. A top of a respective one bottom plate is a plane. A coupling layer is formed on a top of the respective one bottom plate or a bottom of a respective one top plate, and the coupling layer is an adhesive layer or a vacuum layer. The respective one bottom plate includes at least one groove and at least one tenon formed on a peripheral side of the respective one bottom plate, such that any two adjacent bottom plates are connected. The respective one top plate includes at least one groove and at least one tenon formed on a peripheral side of the respective one top plate, such that any two adjacent top plates are connected.

12 Claims, 4 Drawing Sheets

(56) References Cited

U.S. PATENT DOCUMENTS

| | | | | |
|---|---|---|---|---|
| 2007/0193179 | A1* | 8/2007 | Risi | B32B 3/12 52/591.4 |
| 2007/0214741 | A1* | 9/2007 | Llorens Miravet | E04F 15/02 52/592.1 |
| 2010/0281810 | A1* | 11/2010 | Ruland | E04F 15/02 52/588.1 |
| 2013/0104485 | A1* | 5/2013 | Meersseman | B27N 7/00 428/53 |

* cited by examiner

SPLIT FLOORS AND METHOD OF MAKING THE SAME

FIELD OF THE INVENTION

The present invention relates to a composite floor, and more particularly to split floors and a method of madding the same.

BACKGROUND OF THE INVENTION

A conventional floor is one-piece formed. For example, the floor contains a ceramic tile structure and a composite structure which are one-piece formed. However, when desiring to replace the floor, the floor is removed from a ground, and a new floor is fixed on the ground.

In other words, it is troublesome to detach a coupling layer of the composite structure of the floor is from the ground, and a pipe system of the ground is damaged when detaching the floor.

The present invention has arisen to mitigate and/or obviate the afore-described disadvantages.

SUMMARY OF THE INVENTION

One aspect of the present invention is to provide split floors and a method of making the same which are capable of replacing the split floors quickly and easily at a low cost.

To obtain the above aspects, a split floor provided by the present invention contains: at least one bottom plate fixed on a ground, at least one top plate connected on the at least one bottom plate. A top of a respective one bottom plate is a plane, a coupling layer is formed on a top of the respective one bottom plate or a bottom of a respective one top plate, and the coupling layer is an adhesive layer or a vacuum layer which is connected on the top of the respective one bottom plate.

The respective one bottom plate includes at least one groove and at least one tenon which are formed on a peripheral side of the respective one bottom plate, such that any two adjacent bottom plates are connected.

The respective one top plate includes at least one groove and at least one tenon which are formed on a peripheral side of the respective one top plate, such that any two adjacent top plates are connected.

A method of making split floors contains steps of:

- providing a bottom plate and a top surface, wherein a coupling layer is formed on the top plate;
- connecting the top plate on the bottom plate, wherein the top plate is attached or is adhered on the bottom plate to form a connection floor;
- cutting the connection floor, wherein the connection floor is cut into at least two split floors in a desired size;
- processing the at least two split floors, wherein the at least two split floors are formed to have at least one groove and at least one tenon, and the at least two split floors are trimmed, wherein the top plate or the bottom plate of a respective one split floor has the at least one groove or the at least one tenon formed on a peripheral side of the top plate or the bottom plate; or the top plate and the bottom plate of a respective one split floor have the at least one groove or the at least one tenon formed on a peripheral side of the top plate and the bottom plate; and
- finishing the at least two split floors in a packaging manner, wherein the at least two split floors are packaged, and the respective one split floor has the top plate and the bottom plate attached or adhered on the top plate.

In operation, multiple bottom plates are fixed on the ground, and multiple top plates are movably attached or adhered on tops of the multiple bottom plates, thus connecting the multiple bottom plates with the multiple top plates easily and quickly without using any adhesive material. A connection force between the coupling layer and the top plate is twice to 10 times more than a connection force between the coupling layer and the bottom plate.

DETAILED DESCRIPTION OF THE PREFERRED EMBODIMENTS

Figure 1:
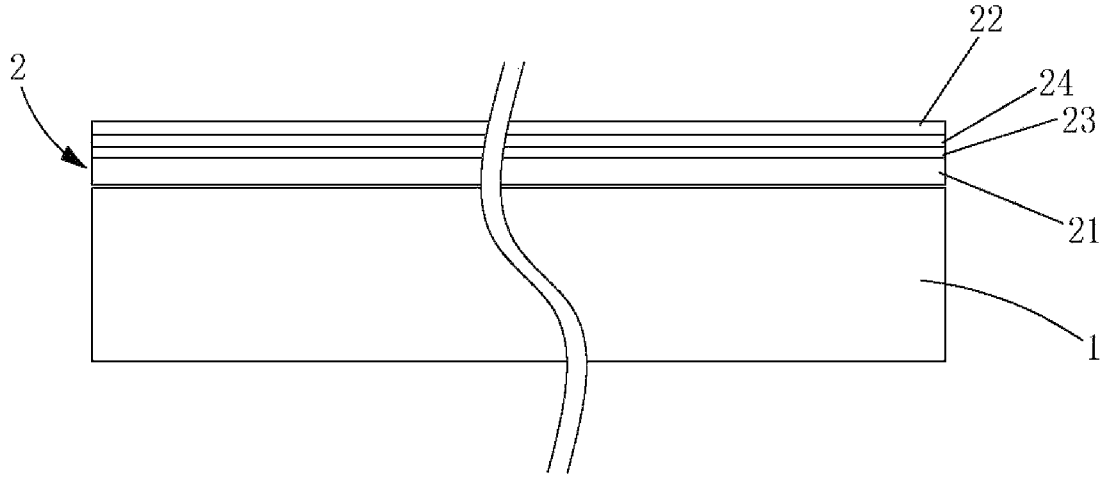
FIG. 1 is a side plan view showing the assembly of a split floor according to a preferred embodiment of the present invention.
Figure 2:
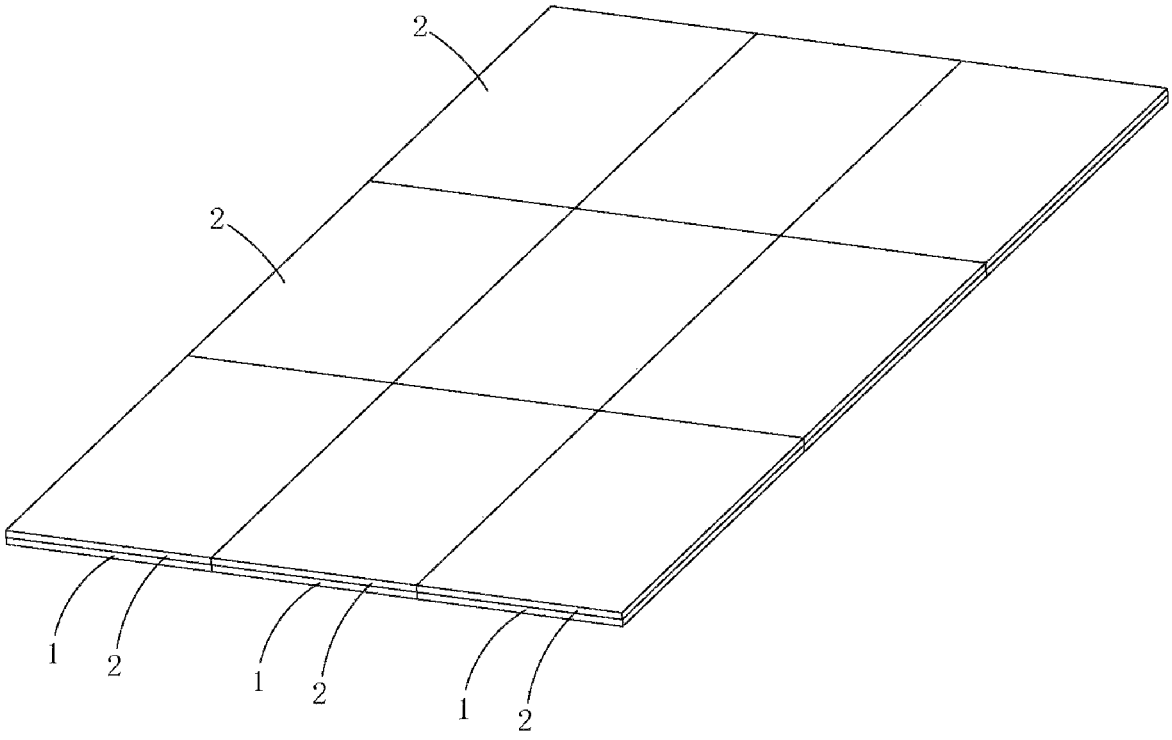
FIG. 2 is a perspective view showing the application of the split floor according to the preferred embodiment of the present invention.
Figure 3:
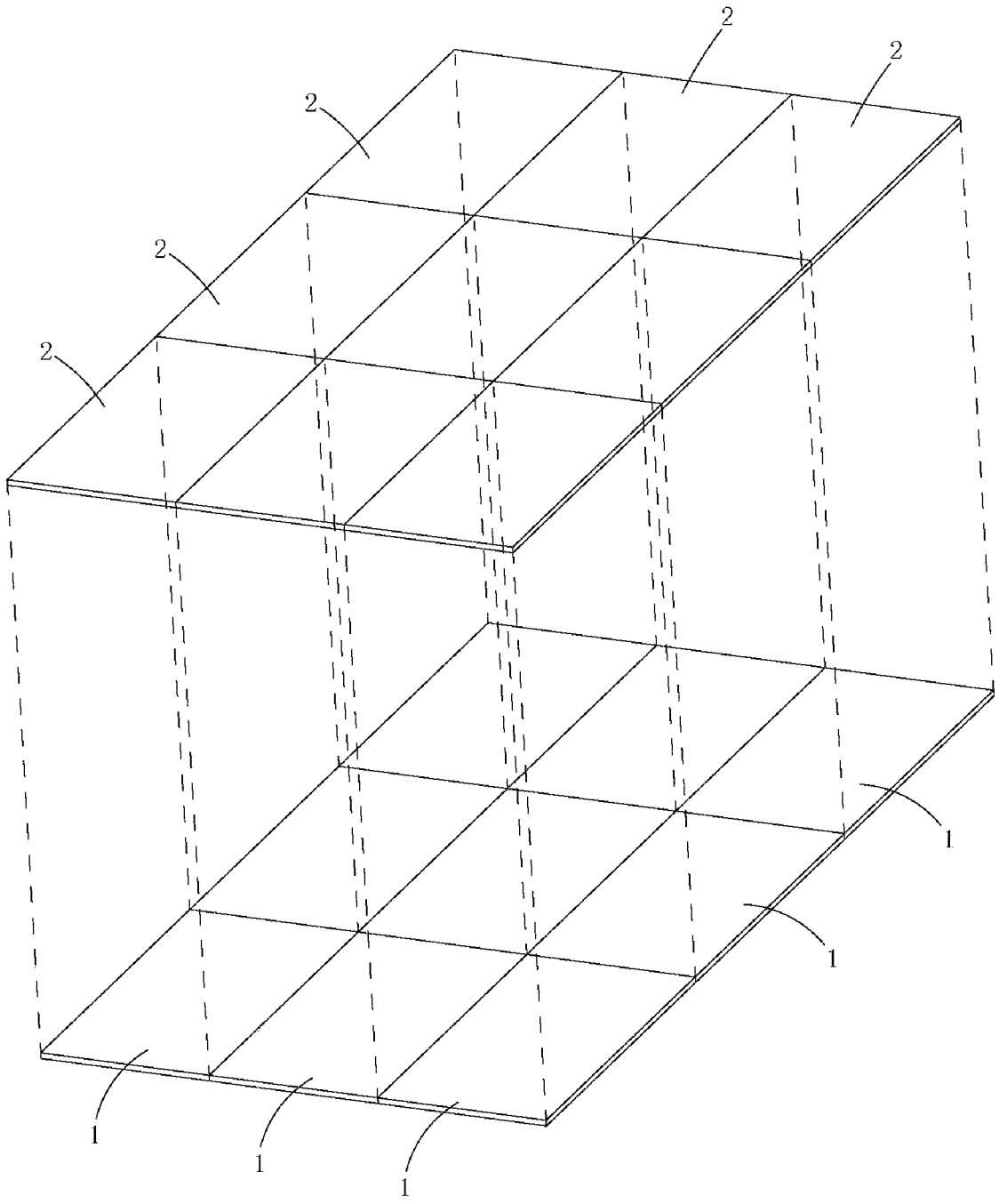
FIG. 3 is another perspective view showing the application of the split floor according to the preferred embodiment of the present invention.
Figure 4:
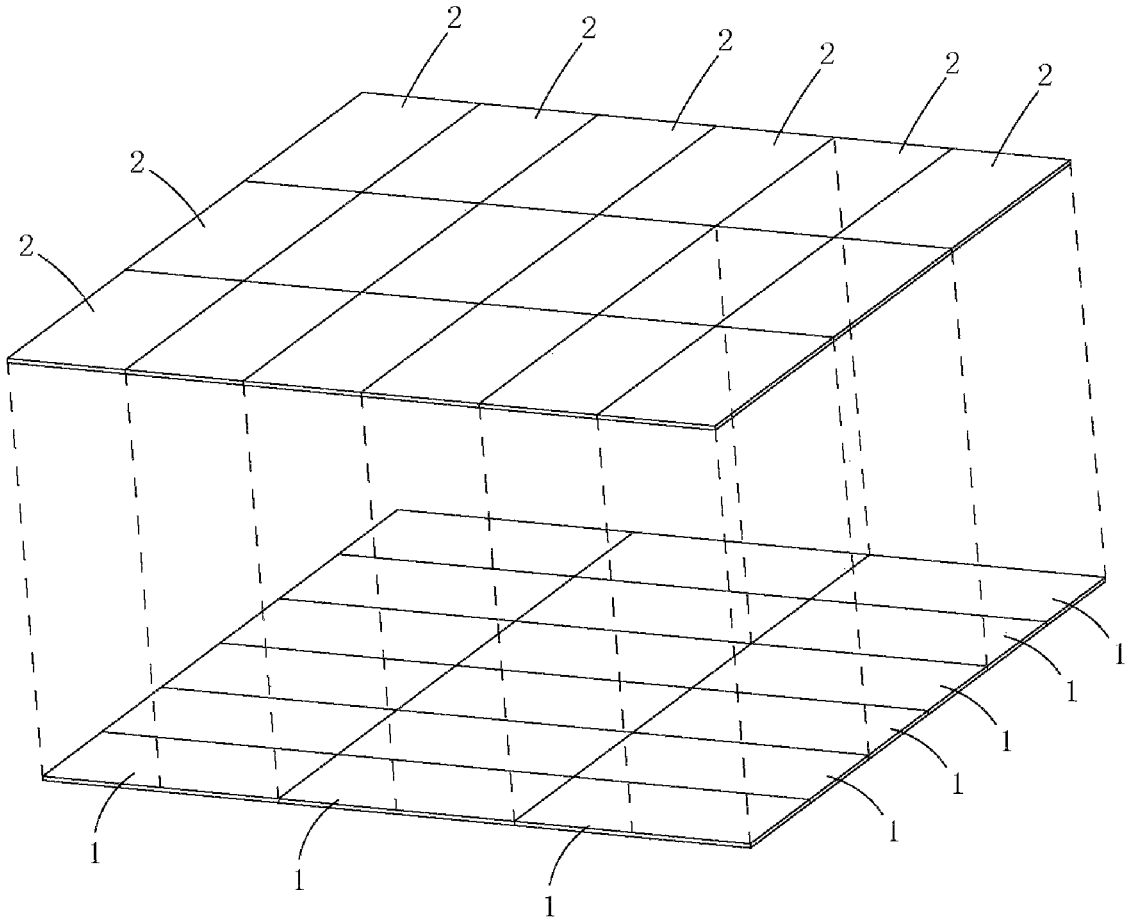
FIG. 4 is still another perspective view showing the application of the split floor according to the preferred embodiment of the present invention.

With reference to FIGS. 1-3, a method of making split floors according to a first embodiment of the present invention comprises steps of:

- providing a bottom plate 1 and a top surface 2, wherein a coupling layer 21 is formed on the top plate 2;
- connecting the top plate 2 on the bottom plate 1, wherein the top plate 2 is attached or is adhered on the bottom plate 1 to form a connection floor;
- cutting the connection floor, wherein the connection floor is cut into at least two split floors in a desired size;
- processing the at least two split floors, wherein the at least two split floors are formed to have at least one groove and at least one tenon, and the at least two split floors are trimmed, wherein the top plate 2 or the bottom plate 1 of a respective one split floor has the at least one groove or the at least one tenon formed on a peripheral side of the top plate 2 or the bottom plate 1; or the top plate 2 and the bottom plate 1 of a respective one split floor have the at least one groove or the at least one tenon formed on a peripheral side of the top plate 2 and the bottom plate 1;
- finishing the at least two split floors in a packaging manner, wherein the at least two split floors are packaged, and the respective one split floor has the top plate 2 and the bottom plate 1 attached or adhered on the top plate 2.

In operation, the at least two split floors are paved on a ground without detaching the top plate 2 from the bottom plate 1 or without attaching or adhering the top plate 2 on the bottom plate 1. When desiring to replace the top plate 2, the top plate 2 is torn off from the bottom plate 1.

Referring to FIGS. 1-4, a method of making split floors according to a second embodiment of the present invention comprises steps of:

- providing a bottom plate 1 and a top plate 2, and wherein a coupling layer 21 is formed on the top plate 2;

cutting the bottom plate 1 is cut into at least two split bottom sheets in a desired size, and cutting the top plate 2 into at least two split top sheets;

processing the at least two split bottom sheets and the at least two split top sheets, wherein the at least two split bottom sheets and the at least two split top sheets are formed to have at least one groove and at least one tenon, and the at least two split bottom sheets and the at least two split top sheets are trimmed, wherein a respective one split top sheet or a respective one split bottom sheet has the at least one groove or the at least one tenon formed on a peripheral side of the respective one split top sheet or the respective one split bottom sheet, or the respective one split top sheet and the respective one split bottom sheet have the at least one groove or the at least one tenon formed on a peripheral side of the respective one split top sheet and the respective one split bottom sheet;

finishing the at least two split bottom sheets and the at least two split top sheets in two packaging manners;

wherein before the at least two split bottom sheets and the at least two split top sheets are finished in a first packaging manner, the at least two split bottom sheets and the at least two split top sheets are attached or adhered to form a split floor, and the split floor is fixed on a ground directly.

wherein when the at least two split bottom sheets and the at least two split top sheets are finished in a second packaging manner, the at least two split bottom sheets and the at least two split top sheets are packaged independently, wherein the split floor includes the top plate 2 packaged independently, and the split floor includes the bottom plate 1 packaged independently.

In operation, multiple bottom plates 1 are fixed on the ground, and multiple top plates 2 are attached or adhered on the multiple bottom plates 1, wherein a respective one of the multiple bottom plates 1 is or is not aligned with a respective one of the multiple top plates 2.

With reference to FIG. 1, a split floor made by the method of the present invention comprises a bottom plate 1 and a top plate 2 corresponding to the bottom plate 1 and connected on a top of the bottom plate 1, wherein the top of the bottom plate 1 is a plane, the top plate 2 includes a coupling layer 21 formed on a bottom thereof and configured to connect the top plate 2 on the top of the bottom plate 1.

The top plate 2 includes a substrate 23, a pattern layer 24 formed on a top of the substrate 23, a wear resistant layer 22 formed on a top of the pattern layer 24. The wear resistant layer 22 has at least one of UV paint layer, a plastic protection film and a melamine adhesive paper layer. The pattern layer 24 has patterns attached on the substrate 23 in any one of a screen printing manner, a transfer printing manner. Alternatively, the pattern layer 24 has patterns printing on the substrate 23 in 3D printing manner, wherein the patterns of the pattern layer 24 of the substrate 23 is formed on a color film, and the color film of the pattern layer 24 is made of coated PVC or coated paper.

The coupling layer 21 has an attaching portion made of any one of EVA, IXPE, PP, PE, and PVC. Alternatively, the top plate 2 includes an adhesive layer formed on the bottom thereof and made of glue or acrylate core-shell copolymer emulsion. Alternatively, the top plate 2 includes EVA upholstery.

The coupling layer 21 has at least two attaching portions, wherein one of the at least two attaching portions is selected from any one of EVA upholstery, EVA upholstery, IXPE upholstery, PP upholstery, PE upholstery, and PVC upholstery. The other attaching portion of the coupling layer 21 is an adhesive layer. In this embodiment, the top plate 2 includes the adhesive layer and the EVA upholstery.

The coupling layer 21 is adhered on the bottom of the top plate 2 and movably connected on the top of the bottom plate 1. Alternatively, the coupling layer 21 is a vacuum layer so as to attach on the top of the bottom plate 1.

In operation, multiple bottom plates 1 are fixed on the ground, and multiple top plates 2 are movably attached or adhered on tops of the multiple bottom plates 1, thus connecting the multiple bottom plates 1 with the multiple top plates 2 easily and quickly without using any adhesive material. A connection force between the coupling layer 21 and the top plate 2 is twice to 10 times more than a connection force between the coupling layer 21 and the bottom plate 1. Preferably, the connection force between the coupling layer 21 and the top plate 2 is at least one 10 times more than the connection force between the coupling layer 21 and the bottom plate 1, thus replacing the top plate 2 easily.

When desiring to replace the split floor, the top plate 2 is removed to replace a new top plate 2. Since the top plate 2 is connected on the top of the bottom plate 2 by using the coupling layer 21, the coupling layer 2 of the top plate 2 is torn off from the top of the bottom plate 1 quickly and safely to protective the top of the bottom plate 1. When desiring to fix the top plate 2 on the bottom plate 1, the top plate 2 is movably attached or adhered on the top of the bottom plate 1, thus replacing the split floor quickly and easily at a low cost.

The top plate 2 is not damaged after being removed from the bottom plate 1 and is recyclable. For example, the top plate 2 is connected on another bottom plate 1 or another position of the bottom plate 1. Preferably, the bottom plate 1 is recyclable to be fixed on another ground.

The bottom plate 1 is sanded to form a sanded plane on the bottom plate 1, and the sanded plane of the bottom plate 1 has at least one of a melamine adhesive paper layer, a glue layer, a UV paint layer, and a plastic film layer. For example, the sanded plane of the bottom plate 1 has the melamine adhesive paper layer. Alternatively, the sanded plane of the bottom plate 1 has a UV paint layer so as to protect the top of the bottom plate 1 and to attach or adhere with the top plate 2.

A thickness of the bottom plate 2 is within 1 mm to 15 mm. Preferably, a thickness of the bottom plate 2 is within 1 mm to 9 mm and is equal to a total thickness of the wear resistant layer 22, the substrate 23, and the coupling layer 21. The substrate 23 is made of any one of a medium-high density fiberboard, a MGO board, a solid wood sheet, a SPC board, a LVT board, a WPC board, a plastic board, a ceramic tile, and a stone plate. Alternatively, the substrate 23 is made of at least two of a medium-high density fiberboard, a MGO board, a solid wood sheet, a SPC board, a LVT board, a WPC board, a plastic board, a ceramic tile, and a stone plate, wherein the MGO board is a magnesium oxide board, and the SPC board, the LVT board, the WPC board is made of Polyvinyl Chloride (PVC).

The coupling layer 21 of the top plate 2 is a ceramic tile having a glaze surface. Alternatively, the coupling layer 21 of the top plate 2 is a stone plate made of marble or artificial stone.

The bottom plate 1 further includes a damp-proof layer formed on a bottom thereof, and the damp-proof layer of the bottom plate 1 is at least one of a UV paint layer, a melamine adhesive paper layer, and a waterproof upholstery, wherein the waterproof upholstery is made of any one of cork, EVA, IXPE, PP, PE and PVC.

A thickness of the bottom plate 2 is within 1 mm to 15 mm. The bottom plate 2 is made of waterproof and fireproof material. For instance, the bottom plate 2 is made of any one of a medium-high density fiberboard, a MGO board, a cement board, a calcium silicate board, a calcium sulfate board, a solid wood sheet, a SPC board, a WPC board, a plastic board, and a ceramic tile. Alternatively, the bottom plate 1 is made of at least two of a medium-high density fiberboard, a MGO board, a cement board, a calcium silicate board, a calcium sulfate board, a solid wood sheet, a SPC board, a WPC board, a plastic board, and a ceramic tile.

When fixing the multiple top plates 2 on the multiple bottom plates 1, a total size of the multiple top plates 2 is equal to a total size of the multiple bottom plate 1, and a number of the multiple top plates 2 is equal to or is not equal to a number of the multiple top plates 2, wherein when a number of the multiple top plates 2 is not equal to a number of the multiple bottom plates 1, a size of a respective one top plate 2 is not equal to a size of a respective one bottom plate 1. When a number of the multiple top plates 2 is equal to a number of the multiple bottom plates 1, a size of a respective one top plate 2 is equal to a size of a respective one bottom plate 1. In addition, the multiple top plates 2 are also configured to be connected on the ground directly.

In one embodiment, when the multiple top plates 2 are fixed on the multiple bottom plates 1, wherein 1) a respective one top plate 2 is connected on a respective one bottom plate 1; or 2) a respective one top plate 2 is connected on at least two bottom plates 1; or 3) at least two top plates 2 are connected on a respective bottom plate 1.

In one embodiment, the respective one bottom plate 1 includes at least one groove and at least one tenon which are formed on a peripheral side of the respective one bottom plate 1, such that any two adjacent bottom plates 1 are connected. The respective one top plate 2 includes at least one groove and at least one tenon which are formed on a peripheral side of the respective one top plate 2, such that any two adjacent top plates 2 are connected. Alternatively, a peripheral side of the respective one top plate 2 is a plane so that any two adjacent top plates 2 are connected.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A split floor comprising:

at least one bottom plate (1) fixed on a ground, at least one top plate (2) connected on the at least one bottom plate (1), wherein a top of a respective one bottom plate (1) of the at least one bottom plate (1) is a plane, a coupling layer (21) is formed on a top of the respective one bottom plate (1) or a bottom of a respective one top plate (2), and the coupling layer (21) is an adhesive layer or a vacuum layer which is connected on the top of the respective one bottom plate (1);

wherein the split floor comprises one of the at least one bottom plate (1) and one of the at least one top plate (2), and the one top plate (2) includes the coupling layer (21) formed on a bottom thereof and configured to movably attached or adhered on a top of the one bottom plate (1);

wherein the one top plate (2) includes a substrate (23), a pattern layer (24) formed on a top of the substrate (23), and a wear resistant layer (22) formed on a top of the pattern layer (24); wherein a connection force between the coupling layer (21) and the one top plate (2) is at least twice more than a connection force between the coupling layer (21) and the one bottom plate (1); and a peripheral side of the one top plate (2) is a plane.

2. The split floor as claimed in claim 1, wherein the substrate (23) is made of any one of a medium-high density fiberboard, a MGO board, a solid wood sheet, a SPC board, a LVT board, a WPC board, a plastic board, a ceramic tile, and a stone plate.

3. The split floor as claimed in claim 1, wherein the substrate (23) is made of at least two of a medium-high density fiberboard, a MGO board, a solid wood sheet, a SPC board, a LVT board, a WPC board, a plastic board, a ceramic tile, and a stone plate.

4. The split floor as claimed in claim 1, wherein the one bottom plate (2) is made of any one of a medium-high density fiberboard, a MGO board, a cement board, a calcium silicate board, a calcium sulfate board, a solid wood sheet, a SPC board, a WPC board, a plastic board, and a ceramic tile.

5. The split floor as claimed in claim 1, wherein the one bottom plate (1) is made of at least two of a medium-high density fiberboard, a MGO board, a cement board, a calcium silicate board, a calcium sulfate board, a solid wood sheet, a SPC board, a WPC board, a plastic board, and a ceramic tile.

6. The split floor as claimed in claim 1, wherein the coupling layer (21) has an attaching portion made of any one of EVA, IXPE, PP, PE, and PVC.

7. The split floor as claimed in claim 6, wherein a thickness of the one top plate (2) is within 1 mm to 15 mm, and a thickness of the one bottom plate (1) is within 1 mm to 15 mm;

wherein a top of the one bottom plate (1) is a plane, and the one top plate (2) includes a coupling layer formed on a bottom thereof and configured to attach the one top plate (2) on the top of the one bottom plate (1);

wherein the one bottom plate (1) further includes a damp-proof layer formed on a bottom thereof, and the damp-proof layer of the bottom plate (1) is at least one of a UV paint layer, a melamine adhesive paper layer, and a waterproof upholstery;

the wear resistant layer (22) has at least one of UV paint layer, a plastic protection film and a melamine adhesive paper layer; and wherein the pattern layer (24) is made of coated PVC or coated paper.

8. The split floor as claimed in claim 7, wherein multiple bottom plates (1) are fixed on the ground, and multiple top plates (2) are connected on the multiple bottom plates (1), wherein a respective one of the multiple top plates (2) is aligned with a respective one of the multiple top plates (2).

9. The split floor as claimed in claim 7, wherein multiple bottom plates (1) are fixed on the ground, and multiple top plates (2) are connected on the multiple bottom plates (1), wherein a respective one top plate 2 is connected on at least two bottom plates (1).

10. The split floor as claimed in claim 7, wherein the one bottom plate (1) and the one top plate (2) are packaged; or the one bottom plate (1) is not packaged with the one top plate (2).

11. The split floor as claimed in claim 1, wherein the coupling layer (21) has at least two attaching portions, wherein one of the at least two attaching portions is selected from any one of EVA upholstery, EVA upholstery, IXPE upholstery, PP upholstery, PE upholstery and PVC upholstery, and the other attaching portion of the coupling layer (21) is an adhesive layer.

12. The split floor as claimed in claim 1, wherein the one bottom plate (1) is sanded to form a sanded plane on the bottom plate (1), and the sanded plane of the one bottom plate (1) has at least one of a melamine adhesive paper layer, a glue layer, a UV paint layer, and a plastic film layer.

* * * * *